US006536618B1

(12) United States Patent
Hwang et al.

(10) Patent No.: US 6,536,618 B1
(45) Date of Patent: Mar. 25, 2003

(54) BOTTLE PLUG

(76) Inventors: Hsu-Rong Hwang, 37, Alley 249, Chung Yang Road, Sec. 3, Tu Chen, Taipei Hsien (TW); Sen-Yih Lin, 16, Tai Yi 3rd Street, Jen The Hsiang, Tainan Hsien (TW)

( * ) Notice: Subject to any disclaimer, the term of this patent is extended or adjusted under 35 U.S.C. 154(b) by 0 days.

(21) Appl. No.: 09/868,173

(22) PCT Filed: Oct. 31, 2000

(86) PCT No.: PCT/US00/28866

§ 371 (c)(1),
(2), (4) Date: Jun. 15, 2001

(87) PCT Pub. No.: WO02/36450

PCT Pub. Date: May 10, 2002

(51) Int. Cl.[7] ..... B65D 39/12

(52) U.S. Cl. ..... 215/358; 215/361; 215/364; 220/234

(58) Field of Search ..... 215/358–361, 215/364, 308, 295, 296, 299, 279, 246, 253, 254; 220/234–238

(56) References Cited

U.S. PATENT DOCUMENTS 869,700 A * 10/1907 Fraser ..... 215/360
1,693,569 A * 11/1928 Wilhelm ..... 215/359
2,718,974 A * 9/1955 Helbig ..... 215/360
2,822,103 A * 2/1958 Moeller ..... 215/359
2,940,629 A * 6/1960 Cros ..... 215/359
3,430,777 A * 3/1969 Esposito, Jr. et al. ..... 215/361
3,638,821 A * 2/1972 Guala ..... 215/364
4,902,270 A * 2/1990 Comeau et al. ..... 215/341
5,722,548 A * 3/1998 Hojnoski ..... 215/296
5,732,837 A * 3/1998 Jones ..... 215/308

* cited by examiner

*Primary Examiner*—Nathan J. Newhouse
(74) *Attorney, Agent, or Firm*—Bacon & Thomas, PLLC

(57) ABSTRACT

A bottle plug having a body, a plug and an elastomer member. The body defines a space having an inner circumference that forms a retracted surface that projects inwardly with respect to an axis of the body to define an expansion portion. The plug includes a leg adapted to engage the retracted surface of the body. The elastomer member is configured to receive the combination of the body and plug and further includes an outer circumference which is arranged to be received by a bottle neck. Insertion of the plug into the expansion portion urges the outer circumference of the elastomer member to expand radially to thereby seal the inner circumference of the bottle neck.

30 Claims, 13 Drawing Sheets

BOTTLE PLUG

BACKGROUND OF THE INVENTION

1. Field of the Invention

The present invention is related to a bottle plug and more particularly to the bottle plug which can.be conveniently inserted into a bottle neck and prevents from unlawful reuse in closing process.

2. Description of the Related Art

Liquor, wine or the like is conventionally contained in glass or ceramic bottle. Before the bottling process, distilled heat liquor has already situated in high inner pressure. In the bottling process, when the traditional bottle plug is typically forced into the neck of a filled bottle, the inner pressure in the filled bottle is essentially greater than atmospheric pressure. Typically, the diameter of bottle plug is apt to greater than the inner circumference of the bottle neck in order to sealably confront each other when the plug is axially inserted into the bottle neck. The plug, therefore, is capable of withstanding substantial inner pressure over long storage periods without deterioration or effect on the contents. During the bottling process, it is hard while the plug is inserted as intended into the bottle neck. In particular, the plug is hard to be remained in the bottle neck by an axially directed inner pressure from within the bottle.

The conventional bottle plug is made of cork which has capillary. The inner pressure from within the bottle, thus, will be released through the capillary of the cork during closing bottle process so that the plug has an improved sealable in the bottle neck. However, the plug necessitates to tightly seal the bottle neck and thus it is hard to be inserted into the bottle neck in the bottling process. In addition, wet and aged cork tends to disintegrate and it is often difficult to remove from the bottle neck. Accordingly, it is inconvenient to remove the cork when it is easily snapped in two.

R.O.C. Pat. Publication No. 314,862 published on Sep. 1, 1997 discloses "An improved structure of a bottle plug". FIG. 1 illustrates a perspective view of the bottle plug in accordance with No. 314,862. Referring to FIG. 1, No. 314,862 discloses the bottle plug including an elastomer member 41 and a plug 42. The seal 41 is made of foamed plastic material instead of cork because opening the bottle will snap a cork stopper into two. However, the bottle plug of No. 314,862 fails to be remained in place by the inner pressure from within the bottle during the closing process.

There is a serious problem in the market. Illegal factories fabricate fake liquor or wine by using the used bottles and bottle plugs on which covering a new and intact cap of tinfoil or a plastic material. Accordingly, there is a need of performing the function of indicating whether or not the bottle has previously been opened. Therefore, preventing from reusing bottle plug is one of solutions.

The present invention intends to provide a bottle plug including gas-tight means and reuse-proof means in such way to as to mitigate and overcome the above problem.

SUMMARY OF THE INVENTION

The primary objective of this invention is to provide a bottle plug with a gas-tight means which can be easily inserted into a bottle neck and then tightly seals the bottle that improves efficiency of bottle closing process.

The secondary objective of this invention is to provide the bottle plug with a reuse-proof means which cannot be reused as a new one that can prevent illegal factories from fabricating fake liquor or wine by using the used bottles and bottle plugs.

The present invention is the bottle plug. The bottle plug mainly includes a bottle plug member and an elastomer member. The bottle plug member consists of a gastight means and a reuse-proof means and further inserts into the elastomer member being assembled as a unit to form the bottle plug. When the bottle plug is inserted into a bottle neck, the gas-tight means provides an expansion portion to seal the bottle neck and the reuse-proof means provides an appearance and the function of indicating whether the bottle neck has previously opened or the bottle plug has been used.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings herein.

DETAILED DESCRIPTION OF THE INVENTION

Figure 1:
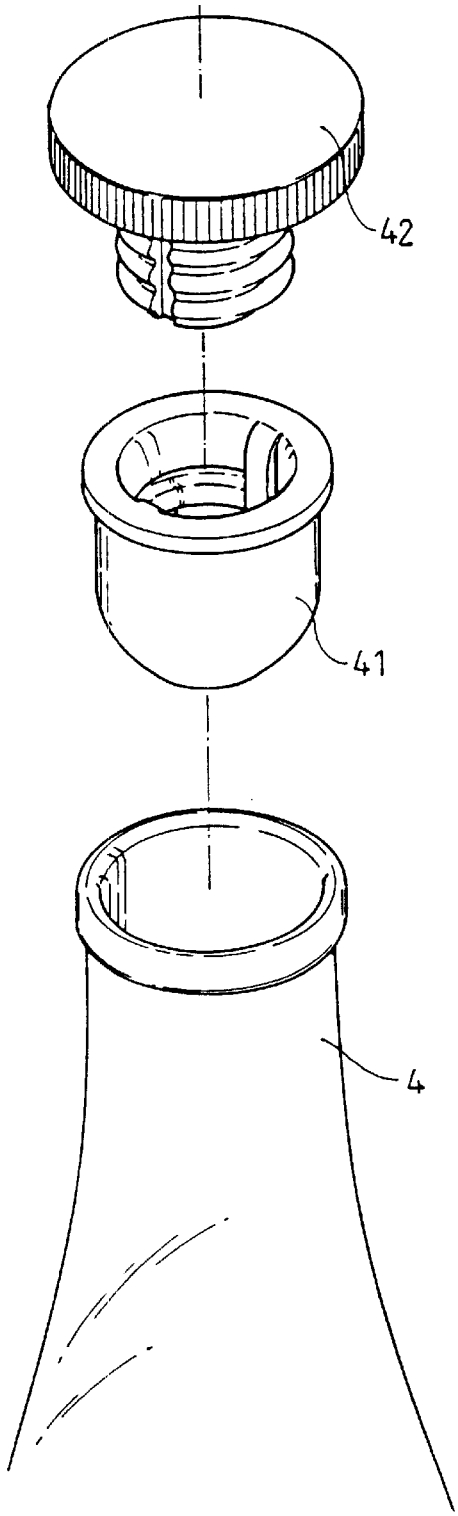
FIG.1 PRIOR ART
FIG. 1 is a perspective view of the bottle plug in accordance with R.O.C. Pat. Publication No. 314,862.
Figure 2:
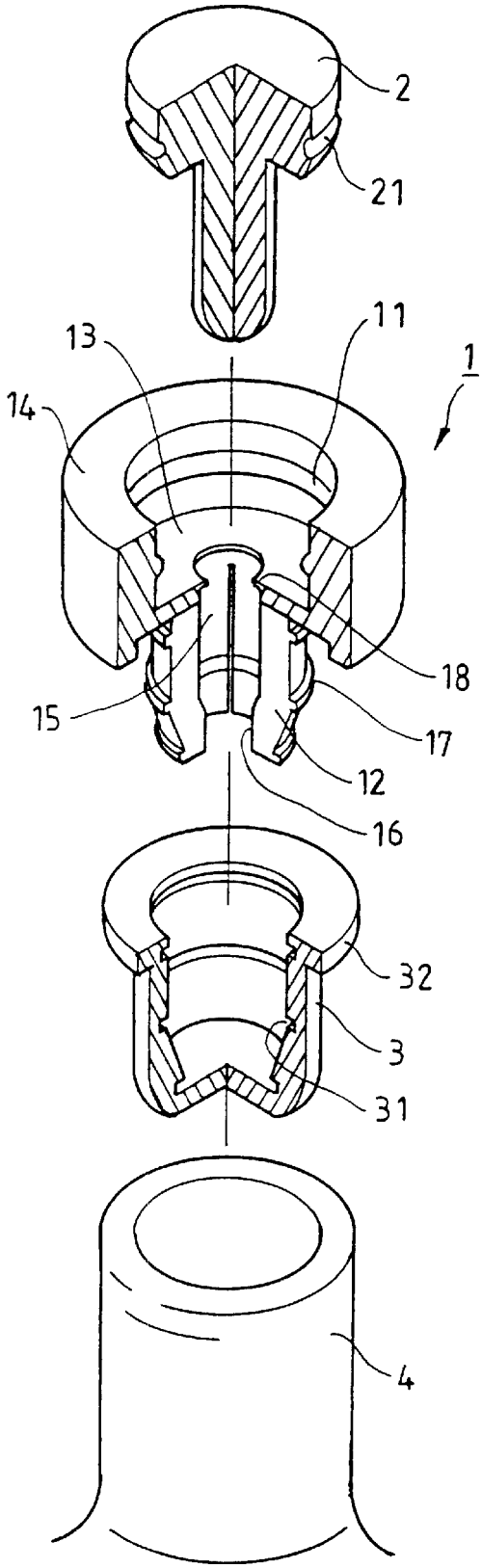
FIG. 2 is a perspective view of the bottle plug in accordance with the first embodiment of the present invention.

Referring to FIG. 2, a bottle plug in accordance with a first embodiment of the present invention mainly includes a body generally designated as numeral 1, a plug as numeral 2 and an elastomer member as numeral 3.

Referring again to FIG. 2, the body 1 includes an annular rib 11 formed on an inner circumference of a wall 14 and a plurality of flexible walls 12 encircled an axis to define a space 15 with an opening. An annular partition 13 of the body 1 provides an upper surface for axially extending the wall 14 defining a compartment and a lower surface for axially extending the walls 12 defining an expansion portion. The inner distal circumference of each wall 12 provides a slightly retracted surface 16 projecting inwardly in a common plane perpendicular to the axis defined by the body 1. The outer circumference of each wall 12 further provides a plurality of ribs 17 projecting outwardly and encircling co-axially around the axis of the body 1. The shape of the plug 2 is dictated somewhat by tradition and etiquette corresponding to the inner circumference of the body 1. Accordingly, the plug 2 essentially consists of a top and a leg. The distal end of the leg provides a slightly tapered end adapted to engage with the retracted surface 16 of the body 1. Correspondingly, the radially outer annular surface of the top provides an annular groove 21 extended around the axis of the plug 2 and adapted to engage with the rib 11 of the body 1. When the leg of the plug 2 is axially inserted into the inner circumference of the body 1, the tapered end is axially aligned to the retracted surface 16. Once the tapered end is engaged with the retracted surface 16, the end of the walls 12 will be forced to expand radially and outwardly. The groove 21 eventually engaged with the rib 11 to form a securely locked position after insertion. The body 1 further provides an annular flange 18 at the edge of a hole of the partition 13 for holding the inserted leg of the plug 2 slightly tight before it is in lock position. The elastomer member 3 may be made of cork, foamed plastic material or the like which cannot chemically contaminate the content within the bottle giving it a distressing taste and permits only a miniscule amount of air to enter the bottle as well as breathing. The elastomer member 3 is cup-shaped part with a cavity in which adapted to receive the combination of the body 1 and the plug 2 aligned co-axially to the elastomer member 3. The inner circumference of the elastomer member 3 includes a plurality of grooves 31 encircling co-axially around its axis corresponding to the ribs 17 for assembling. The outer circumference of the elastomer member 3 corresponding to the expansion portion of the body 1 is adapted to sealably confront the inner circumference of the bottle neck during inserting. It is for convenient to insert the assembled bottle plug into the bottle neck, the outer diameter of the elastomer member 3 is slightly less than the inside bottle neck diameter. The radially outer annular surface 32 of the elastomer member 3 is further provided for confronting the rim of the bottle neck upon insertion.

Figure 3:
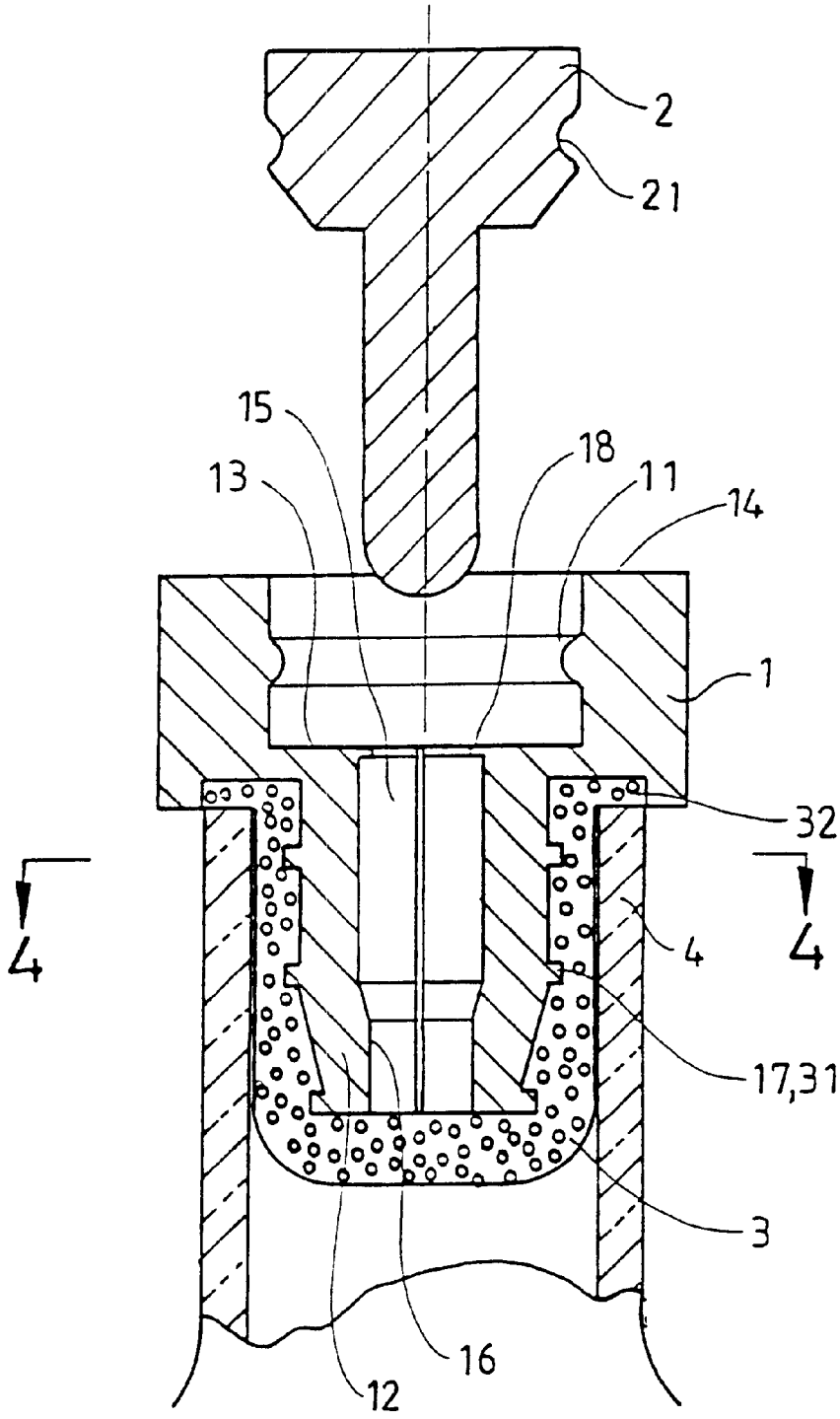
FIG. 3 is a partial sectional view of the bottle plug in accordance with the first embodiment of the present invention in the first step of closing bottle process.
Figure 4:
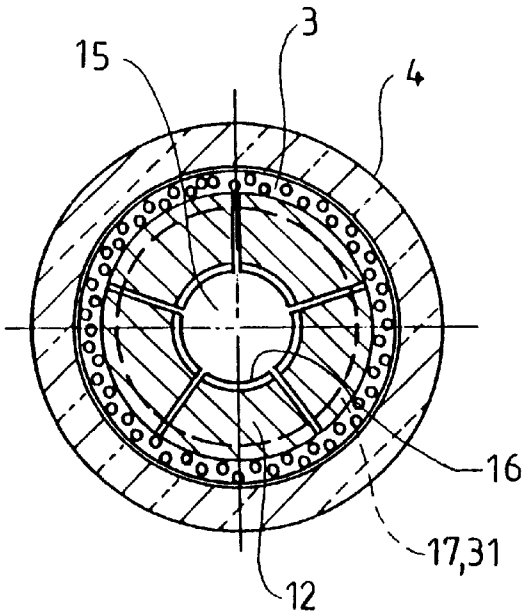
FIG. 4 is a sectional view taken along line 4—4 in FIG. 3.

FIG. 3 illustrates the bottle plug in accordance with the first embodiment of the present invention in the first step of closing bottle process. FIG. 4 is a sectional view taken along line 4—4 in FIG. 3 illustrating the preferred number of five walls 12 inserting into the cavity of the elastomer member 3. The combination of the body 1 and elastomer member 3 has been inserted into the bottle neck 4 in the first step. Because of the body 1 allowing the deformation of the elastomer member 3 in the bottle neck while insertion, it is very convenient to be inserted. Suppose the inner circumference of the bottle neck 4 is 18.2 mm, the maximum outer diameter of the elastomer member 3 is approximately 18.4 mm for insertion as shown by test data.

Figure 5:
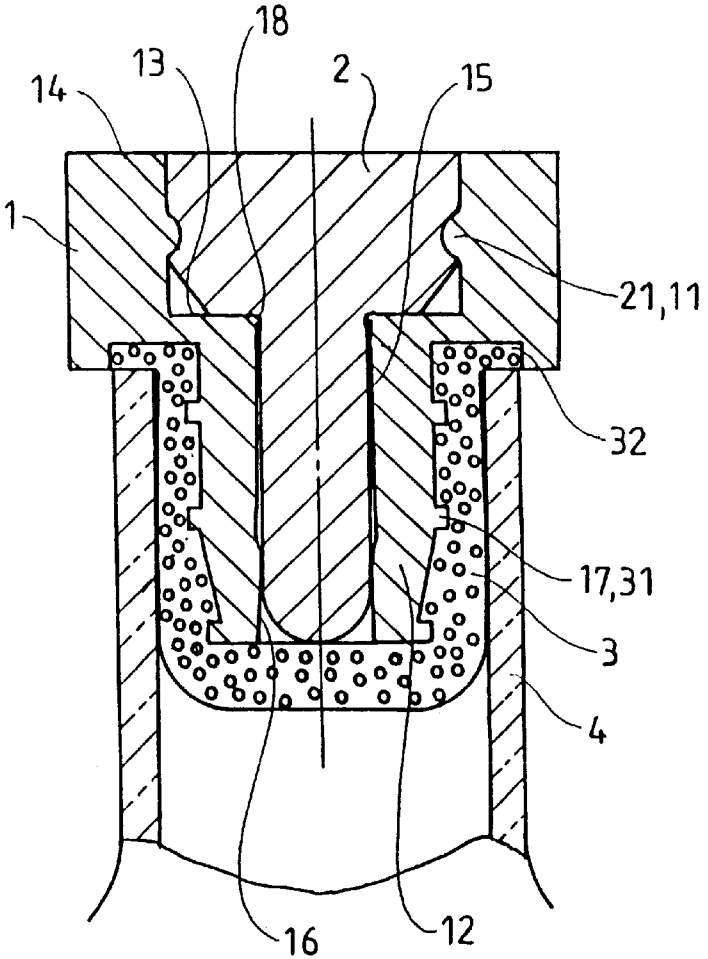
FIG. 5 is a partial sectional view of the bottle plug of the first embodiment of the present invention in the second step of closing bottle process.

FIG. 5 illustrates the bottle plug of the first embodiment of the present invention in the second step of closing bottle process. Referring to FIGS. 4 and 5, the plug 2 is axially aligned to the center of the body 1 and then the leg is inserted into the inner circumference. When the tapered distal end of the plug 2 is being inserted into the space 15 to engage with the retracted surface 16 of the body 1, the distal end actuates the expansion portion defined by the wall expanding in radial outward. Accordingly, when the wall 12 is in expansion, the outer circumference of the elastomer member 3 corresponding to the expansion portion of the body 1 is sealably confronted the inner circumference of the bottle neck 4 that can perform the function of tightly sealing the bottle neck 4. As shown in test data, the maximum outer diameter of the elastomer member 3 removed from the bottle neck accomplishing preferred seal effect is approximately between 18.7 mm and 19.2 mm. While the distal end is rested in the opening of space 15, the groove 21 is engaged with the rib 11 in order to perform the function of positioning the plug 2 that securely locked in the body 1. The elastomers member 3 permits only a miniscule amount of air via the space 15 of the body 1 to enter the bottle as well as breathing. After that package machine covers the bottle plug with a tinfoil or plastic cap mounting on the bottle neck 4.

When the bottle plug of the present invention is removed from the bottle neck 4, it releases the inner pressure of the content within the bottle. Thus users can reuse the bottle plug to insert into and remove from the bottle neck 4 which has been previously opened. However, the bottle plug cannot appear intact if the plug 2 is forced to release or loosen from the body 1 as well as disengaging the rib 11 with the groove 21. On the one hand the used bottle plug is impossible to remove the plug 2 from the body 1, and on the other hand the bottle plug with the maximum outer diameter cannot apply to the high inner pressure, temperature of the content within the bottle in the bottling process. Therefore, illegal factories cannot reuse the bottle plug for fabricating fake liquor because the appearance of the bottle plug reveals initial opening of the bottle.

Figure 6:
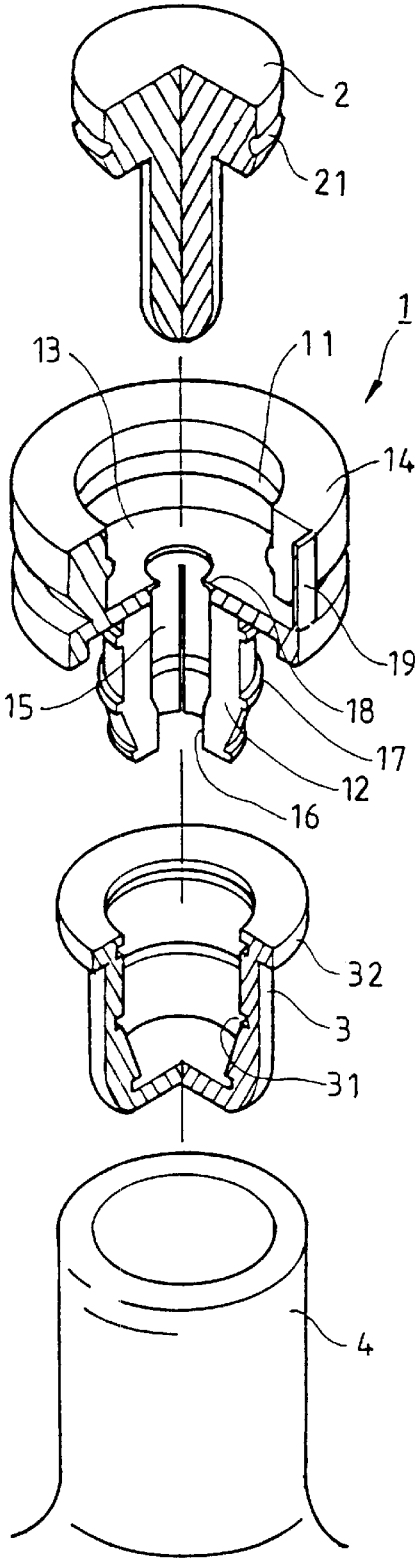
FIG. 6 is a perspective view of the bottle plug in accordance with the second embodiment of the present invention.

FIG. 6 illustrates the bottle plug in accordance with the second embodiment of the present invention. Referring to FIGS. 2 and 6, reference numerals of the second embodiment has applied the identical numerals of the previous embodiment.

Referring to FIG. 6, the body 1 of the second embodiment further includes an annular groove corresponding to the annular partition 13 provided on the bottom of the outer circumference, as well as a radially outer annular surface, of the wall 14. A tear strip 19 connects between the bottom of the wall 14 and the annular partition 13 so that the wall 14 can tear off from the body 1 along its groove. The bottle plug has been inserted into the bottle neck 4 and the elastomer member 3 confronts with the inner circumference of the bottle neck 4 for tightly sealing. For removing the bottle plug from the bottle neck 4, users can tear off the strip 19 and thus the wall 14 is cut along the groove. As the wall 14 is cut along the groove of the body 1 the plug 2 can release from it. The expansion portion of the body 1 is disengaged with the tapered end of the plug 2; meanwhile, the bottle can remove from the bottle neck 4. The appearance of the plug 2 without the wall 14 performs the function of indicating whether the bottle neck 4 has previously opened or the bottle plug has been used. Therefore, it can prevent reuse of the bottle plug.

Figure 7:
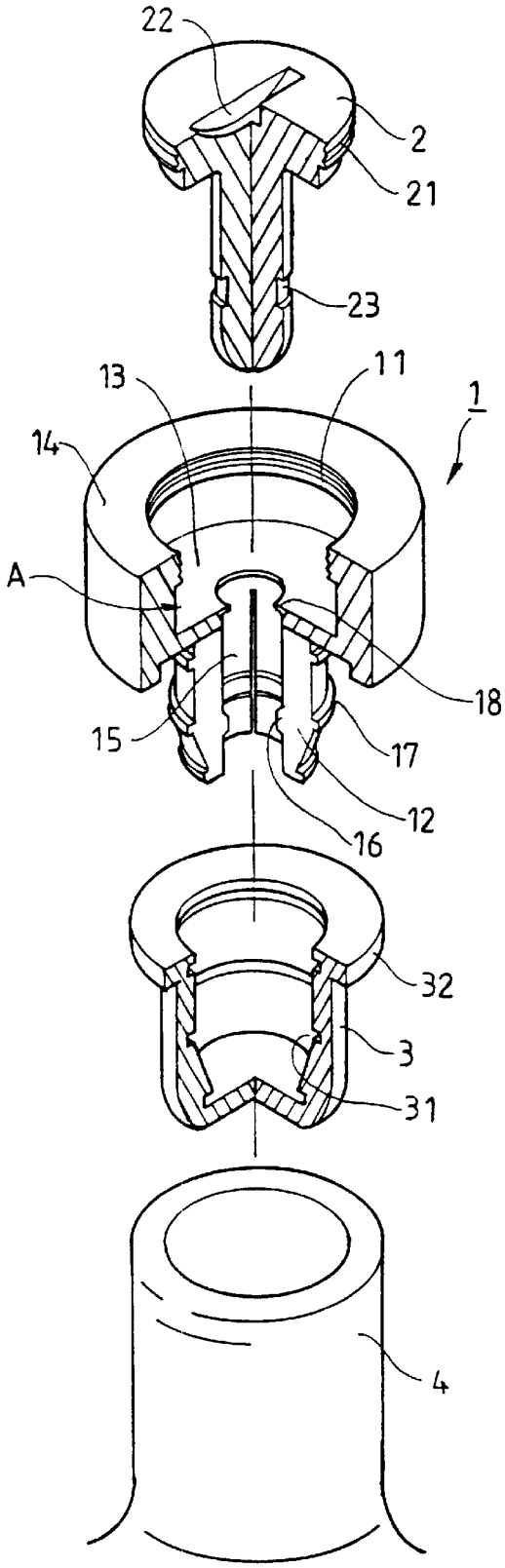
FIG. 7 is a perspective view of the bottle plug in accordance with the third embodiment of the present invention.

FIG. 7 illustrates the bottle plug in accordance with the third embodiment of the present invention. Referring to FIGS. 2 and 7, reference numerals of the third embodiment has applied the identical numerals of the previous embodiment. Referring to FIG. 7, the body 1 of the third embodiment includes a thread 11 and a recession A co-axially formed on an inner circumference of a wall 14 and abutting parallel each other. The plug 2 of the third embodiment provides a corresponding thread 21 for tightening it with the thread 11 while the plug 2 is inserted into the body 1 assembled as a unit. The top of the plug 2 further provides a slot 22 for manually or automatically screwing it. The combination of the body 1 and elastomer member 3 has been inserted into the bottle neck 4 in the first step. The plug 2 for sealing the bottle neck 4 is screwed clockwise to mount in the body 1. Thus the expansion portion of the body 1 is expanded in radial outward due to the tapered distal end of the plug 2 engaging with a protrusion 16 of each the wall 12. For removing the bottle plug from the bottle neck 4, the plug 2 is screwed counterclockwise to release from the body 1 and thus the outer diameter of the bottle plug will reduce due to shrinkage of the expansion portion. Furthermore, the leg of the plug 2 further provides an annular groove 23 for unreleasably engaging with the protrusion 16 of the body 1 in order to prevent reuse. For removing the bottle plug from the bottle neck 4, the plug 2 is screwed clockwise to enable the leg of the plug 2 disengaged with the protrusion 16 of the body 1. The annular groove 23 of the plug 2 is engaged with the inner circumference of the protrusion 16 of the body 1 and thus the outer diameter of the bottle plug will reduce due to shrinkage of the expansion portion. The top of the plug 2 is restricted with an appearance in lock position as it drops into the recession A of the body 1. It performs the function of indicating the bottle plug has been used.

Figure 8:
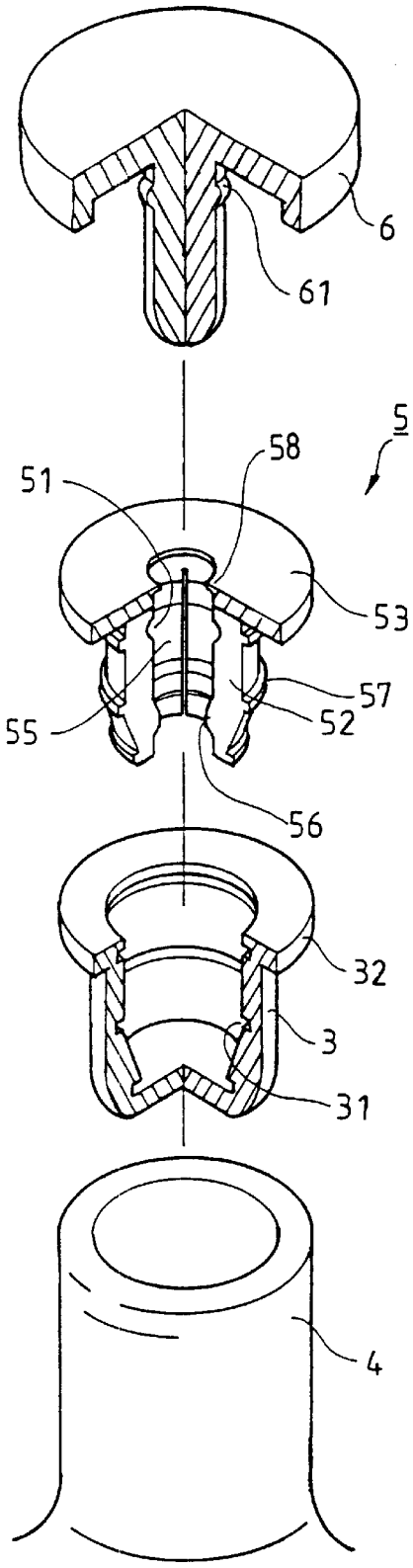
FIG. 8 is a perspective view of the bottle plug in accordance with the fourth embodiment of the present invention.

FIG. 8 illustrates the bottle plug in accordance with the fourth embodiment of the present invention. Referring to FIGS. 2 and 8, reference numerals of the fourth embodiment has applied the identical numerals of the previous embodiment. Referring to FIG. 8, the body 5 of the fourth embodiment includes an annular plate 53 having a hole provided on its center. The body 5 further includes a plurality of flexible walls 52 extended from the periphery of the hole and encircled an axis to define a space 55 with an opening. The inner circumference of each wall 52 provides a groove 51 extending along a circle coaxial to the axis defined by the body 5 and a slightly retracted surface 56 projecting inwardly in a common plane perpendicular to the axis of it. The outer circumference of each wall 52 further provides a plurality of ribs 57 projecting outwardly and encircling co-axially around the axis of the body 5. The shape of the plug 6 of the fourth embodiment is dictated corresponding to the nut-shaped body 5. Accordingly, the plug 6 essentially consists of a top and a leg. The leg provides an annular projection 61 and a slightly tapered end adapted to engage with the groove 51 and the retracted surface 56 of the body 5 respectively. When the leg of the plug 6 is axially inserted into the inner circumference of the body 5, the tapered end is axially aligned to the retracted surface 56. Once the tapered end is engaged with the retracted surface 56, the end of the walls 52 will be forced to expand radially and outwardly. The annular projection 61 eventually engaged with the groove 51 to form a securely locked position after insertion. The body 5 further provides an annular flange 58 at the edge of a hole of the annular plate 53 for holding the inserted leg of the plug 6 slightly tight before it is in lock position. The elastomer member 3 is cup-shaped part with a cavity in which adapted to receive the combination of the body 5 and the plug 6 aligned co-axially to the elastomer member 3. The inner circumference of the elastomer member 3 includes a plurality of grooves 31 encircling co-axially around its axis corresponding to the ribs 57 for assembling. The outer circumference of the elastomer member 3 corresponding to the expansion portion of the body 5 is adapted to sealably confront the inner circumference of the bottle neck during inserting. The technique of inserting and removing the bottle plug has been described in detail in previous embodiment for reference.

Figure 9:
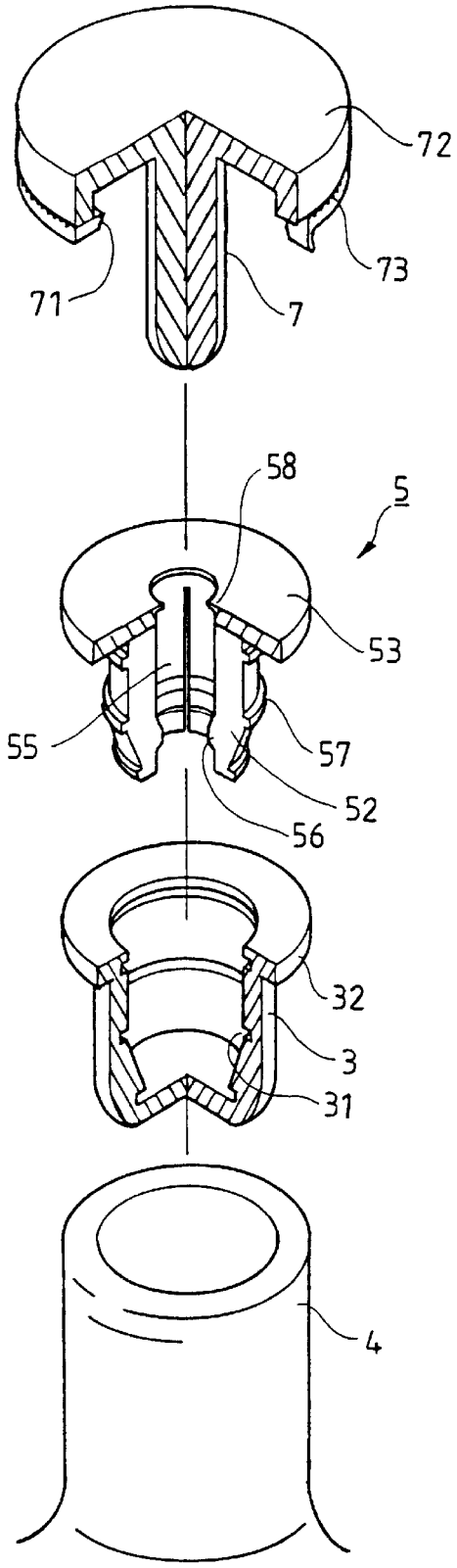
FIG. 9 is a perspective view of the bottle plug in accordance with the fifth embodiment of the present invention.

FIG. 9 illustrates the bottle plug in accordance with the fifth embodiment of the present invention. Referring to FIGS. 8 and 9, reference numerals of the fifth embodiment has applied the identical numerals of the previous fourth embodiment. Referring to FIG. 9, the plug 7 of the fifth embodiment further includes an annular wall extended from the radially outer annular surface in a direction from the top 72 to the leg. An annular tear strip 73 is attached to the rim of the wall and thus the inner lip 71 forms a retainer for retaining the annular plate 53 while the plug 7 is inserted into the body 5. When the leg of the plug 7 is axially inserted into the space 55 of the body 5, the retainer receives fittingly the annular plate 53 and the tapered end is axially aligned to the retracted surface 56. Once the tapered end is engaged with the retracted surface 56, the end of the walls 52 will be forced to expand radially and outwardly. The outer circumference of the elastomer member 3 corresponding to the expansion portion of the body 5 is adapted to sealably confront the inner circumference of the bottle neck during inserting.

Users can tear off the strip 73 from the plug 7 and thus it is cut along the radially outer annular surface of the top 72. The plug 7 releases the annular plate 53 and then the bottle plug can remove from the bottle neck 4. The appearance of the plug 7 without the tear strip 73 performs the function of indicating whether the bottle neck 4 has previously opened or the bottle plug has been used. Therefore, it can prevent reuse of the bottle plug.

Figure 10:
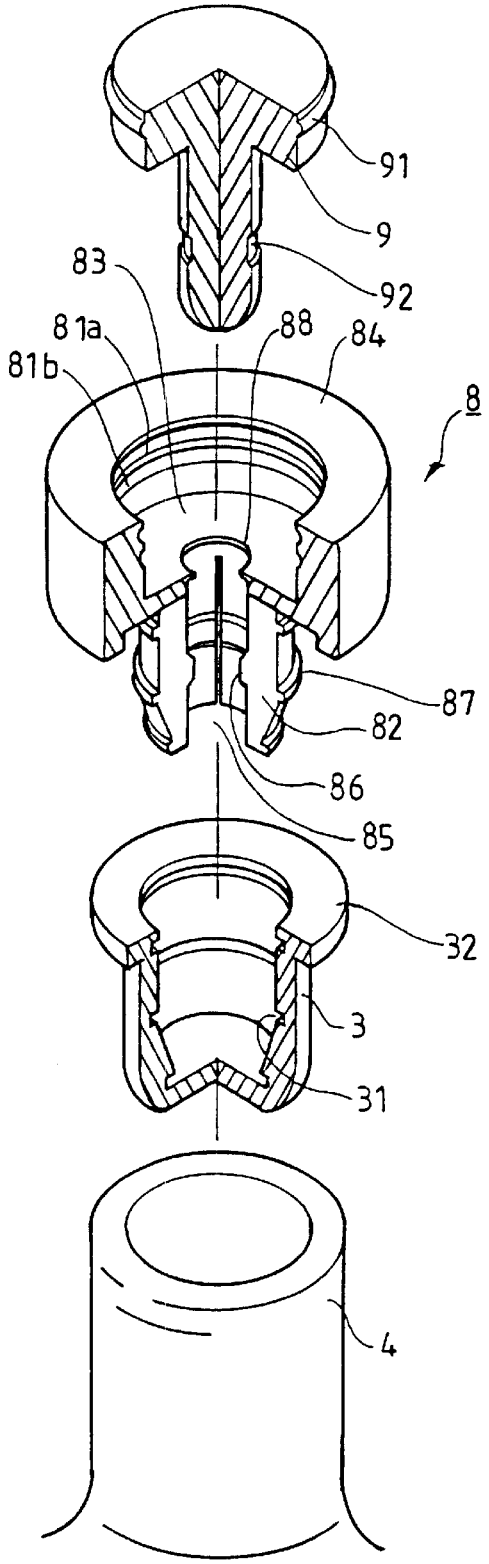
FIG. 10 is a perspective view of the bottle plug in accordance with the sixth embodiment of the present invention.

FIG. 10 illustrates the bottle plug in accordance with the sixth embodiment of the present invention. Referring to FIG. 10, the body 8 includes a first annular rib 81*a* and a second annular rib 81*b* formed on an inner circumference of a wall 84 and a plurality of flexible walls 82 encircled an axis to define a space 85 with an opening. An annular partition 83 of the body 8 provides an upper surface for axially extending the wall 84 defining a compartment and a lower surface for axially extending the walls 82 defining an expansion portion. The inner distal circumference of each wall 82 provides a protrusion 86 projecting inwardly in a common plane perpendicular to the axis defined by the body 8. The outer circumference of each wall 82 further provides a plurality of ribs 87 projecting outwardly and encircling co-axially around the axis of the body 8. The plug 9 essentially consists of a top and a leg. The leg provides a recession 92 and a slightly tapered end adapted to engage in turn with the protrusion 86 of the body 8. Correspondingly, the radially outer annular surface of the top provides an annular groove 91 extended around the axis of the plug 9 and adapted to engage with the ribs 81 of the body 8. When the leg of the plug 9 is axially inserted into the inner circumference of the body 8, the tapered end is axially aligned to the protrusion 86. Once the tapered end is engaged with the protrusion 86, the end of the walls 82 will be forced to expand radially and outwardly. The first groove 81*a* is engaged with the rib 91 to form a securely locked position after insertion. The body 8 further provides an annular flange 88 at the edge of a hole of the partition 83 for holding the inserted leg of the plug 9 slightly tight before it is in lock position. The inner circumference of the elastomer member 3 includes a plurality of grooves 31 encircling co-axially around its axis corresponding to the ribs 87 for assembling.

Figure 12:
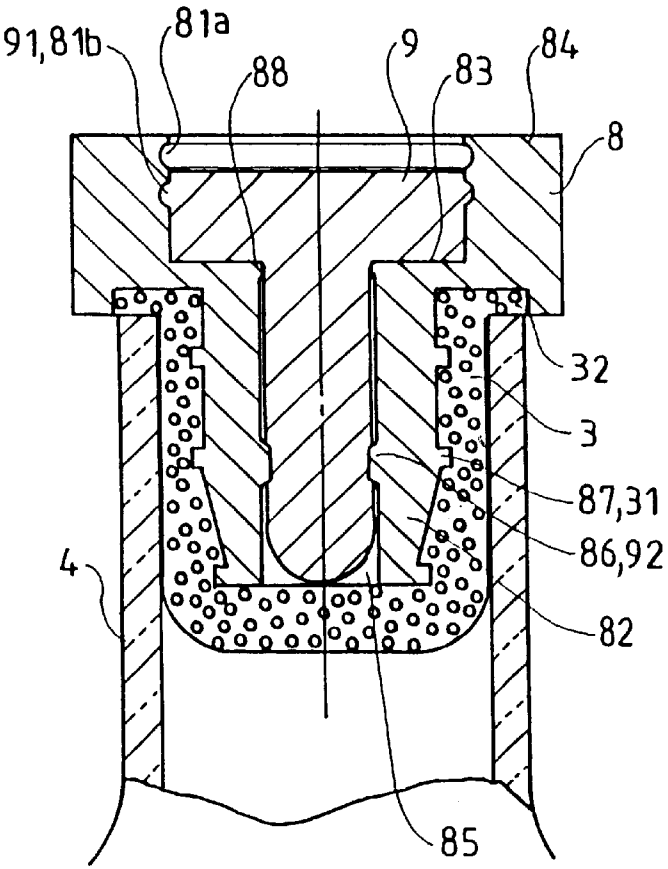
FIG. 12 is a partial sectional view of the bottle plug in accordance with the sixth embodiment of the present invention in the second step of closing bottle process.
Figure 11:
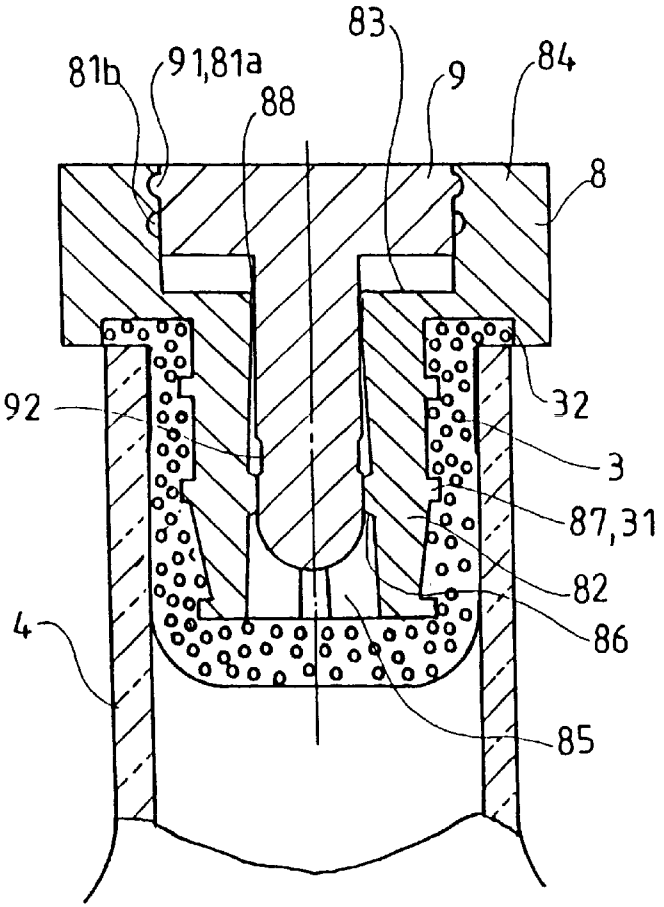
FIG. 11 is a partial sectional view of the bottle plug in accordance with the sixth embodiment of the present invention in the first step of closing bottle process.

FIG. 11 illustrates the bottle plug in accordance with the sixth embodiment of the present invention in the first step of closing bottle process. FIG. 12 illustrates the bottle plug in accordance with the sixth embodiment of the present invention in remove process. Referring to FIG. 11, the outer circumference of the elastomer member 3 corresponding to the expansion portion of the body 8 is adapted to sealably confront the inner circumference of the bottle neck 4 when the distal end of the plug 9 engaged with the inner circumference of the body 8. While the distal end of the plug 9 is rested in the opening of space 85, the rib 91 is engaged with the first groove 81*a* in order to perform the function of positioning the plug 9 that securely locked in the body 8. Referring to FIG. 12, the plug 9 is manually pressed downward along the space 85 of the body 8 by users so that the protrusion 86 is slid into the groove 92 to shrink the expansion portion such that the bottle plug can conveniently remove from the bottle neck 4. The wall 82 is shrunk inwardly and thus the outer diameter of the bottle plug will reduce due to shrinkage of the expansion portion. While the groove 92 of the plug 9 is engaged with the protrusion 86 of the body 8, the rib 91 is engaged with the second groove 81*b* in order to perform the function of positioning the plug 9 that securely locked in the body 8. The appearance of the plug 9 positioned in the groove 81*a* or 81*b* performs the function of indicating whether the bottle neck 4 has previously opened or the bottle plug has been used. Therefore, it can prevent reuse of the bottle plug.

Figure 14:
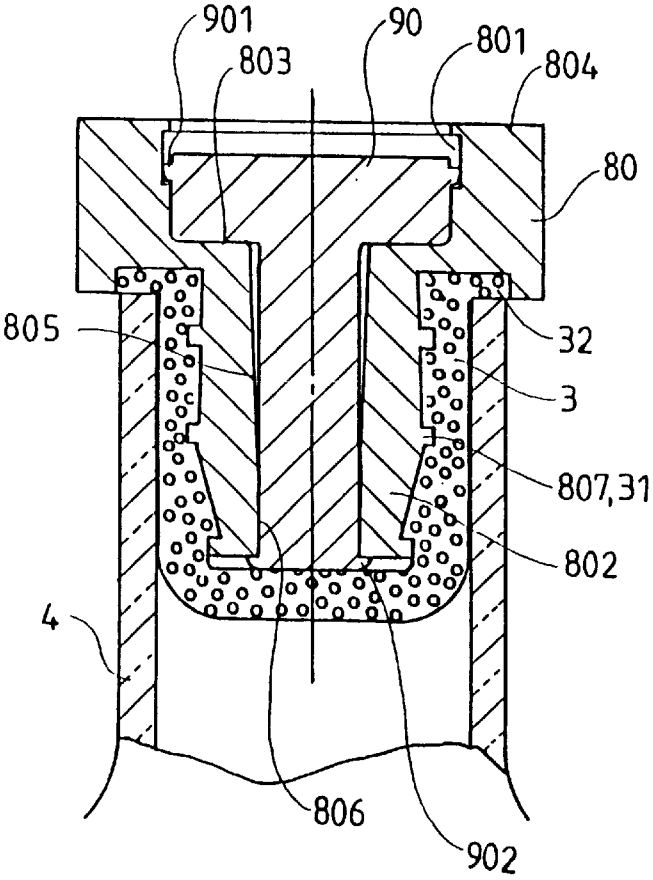
FIG. 14 is a partial sectional view of the bottle plug in accordance with the seventh embodiment of the present invention in the second step of closing bottle process.
Figure 13:
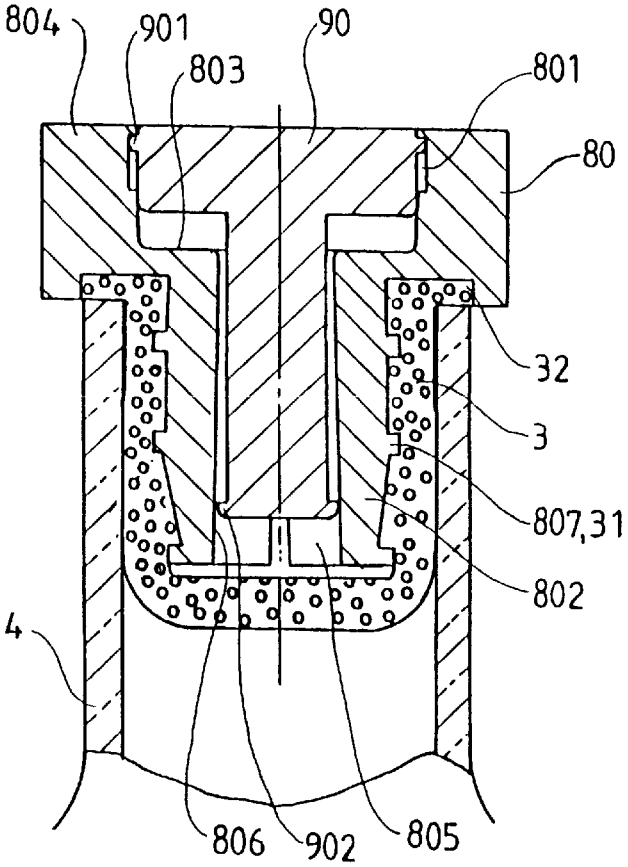
FIG. 13 is a partial sectional view of the bottle plug in accordance with the seventh embodiment of the present invention in the first step of closing bottle process.

FIG. 13 illustrates the bottle plug in accordance with the seventh embodiment of the present invention in the first step of closing bottle process. FIG. 14 illustrates the bottle plug in accordance with the seventh embodiment of the present invention in remove process. Referring to FIG. 13, the body 80 of the seventh embodiment further includes a annular groove 801 formed on an inner circumference of a wall 804 and a plurality of flexible walls 802 encircled an axis to define a space 805 with an opening. An annular partition 803 of the body 80 provides an upper surface for axially extending the wall 804 defining a compartment and a lower surface for axially extending the walls 802 defining an expansion portion. The inner circumference of each wall 802 provides a slightly retracted surface 806 projecting inwardly in a common plane perpendicular to the axis defined by the body 80. The outer circumference of each wall 802 further provides a plurality of ribs 807 projecting outwardly and encircling co-axially around the axis of the body 80. The plug 90 essentially consists of a top and a leg. The ends of the plug 90 provide an annular first flange 901 and an annular second flange 902 adapted to engage with the groove 801 and the retracted inner circumference 806 of the body 80 respectively. When the leg of the plug 90 is axially inserted into the inner circumference 806 of the body 90, the end of the leg is axially aligned to the inner circumference 806 of the wall 802. Once the annular flange 902 is engaged with the inner circumference 806 while pressing the plug 90, the walls 802 will be forced to expand radially and outwardly. The inner circumference of the elastomer member 3 includes a plurality of grooves 31 encircling co-axially around its axis corresponding to the ribs 807 for assembling. The outer circumference of the elastomer member 3 corresponding to the expansion portion of the body 80 is adapted to sealably confront the inner circumference of the bottle neck 4 when the annular flange 902 of the plug 90 engaged with the inner circumference 806 of the body 80. While the annular flange 902 is rested in the space 805, the annular first flange 901 is positioned at the topside of the groove 801 in order to perform the function of positioning the plug 90 securely locked in the body 80. Referring to FIG. 14, the plug 90 is manually pressed downward along the inner circumference of the wall 804 by users for removing bottle plug so that the annular flange 902 slides out of the circumference 806 to shrink the walls 802. The wall 802 is shrunk inwardly and thus the outer diameter of the bottle plug will reduce due to shrinkage of the body 80. While the annular flange 902 of the plug 90 is engaged with the distal end of the body 80, the annular flange 901 is positioned at the bottom side of the groove 801 in order to perform the function of removing the bottle plug. The position of the plug 90 at the topside or bottom side of the groove 801 performs the function of indicating whether the bottle neck 4 has previously opened or the bottle plug has been used. The plug 90 cannot remove from the body 80 due to the annular flange 902 engaged with the opening for preventing reuse.

Figure 15:
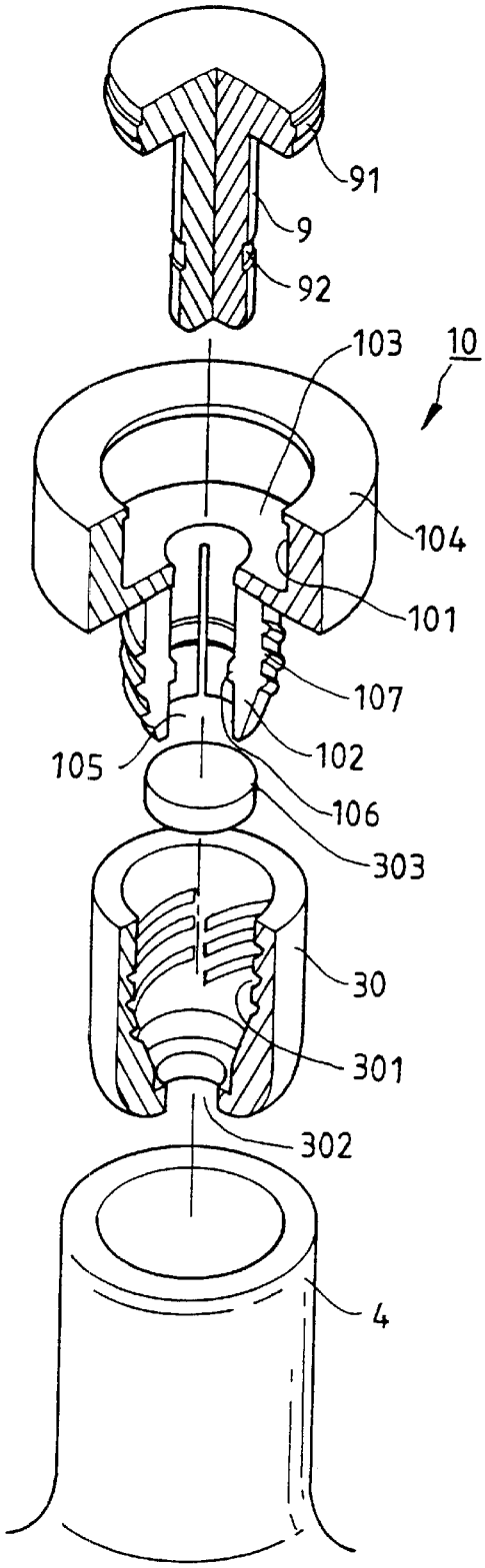
FIG. 15 is a perspective view of the bottle plug in accordance with the eighth embodiment of the present invention.

FIG. 15 illustrates the bottle plug in accordance with the eighth embodiment of the present invention. Referring to FIG. 15, the body 10 of the eighth embodiment further includes a annular groove 101 formed on an inner circumference of a wall 104 and a plurality of flexible walls 102 encircled an axis to define a space 105 with an opening. An annular partition 103 of the body 10 provides an upper surface for axially extending the wall 104 defining a compartment and a lower surface for axially extending the walls 102 defining an expansion portion. The inner circumference of each wall 102 provides a protrusion 106 projecting inwardly in a common plane perpendicular to the axis defined by the body 10. The outer circumference of each wall 102 further provides a plurality of ribs 107 projecting outwardly and arranged at a helical angle with respect to the axis of the body 10. The plug 9 essentially consists of a top and a leg. The leg provides a recession 92 adapted to engage with the protrusion 106 of the body 10. The top of the plug 9 provides an annular flange 91 on its radially outer annular surface adapted to engage with the groove 101 of the body 10. Once the leg of the plug 9 is engaged with the protrusion 106, the end of the walls 102 will be forced to expand radially and outwardly. The inner circumference of the elastomer member 30 includes a plurality of grooves 301 arranged at a helical angle corresponding to the ribs 807 for assembling. Accordingly, the body 10 is inserted into the elastomer member 30 and then rotated at an appropriate angle with respect to the axis of it for fittingly assembly. The body 10 is adhesively received in the elastomer member 30 by adhesive for fear taking apart each other. The bottom of the elastomer member 30 further provides a hole 302 and a filter 303 arranged therein. The filter 303 is made of cork material and permits only a miniscule amount of air to enter the bottle.

Figure 16:
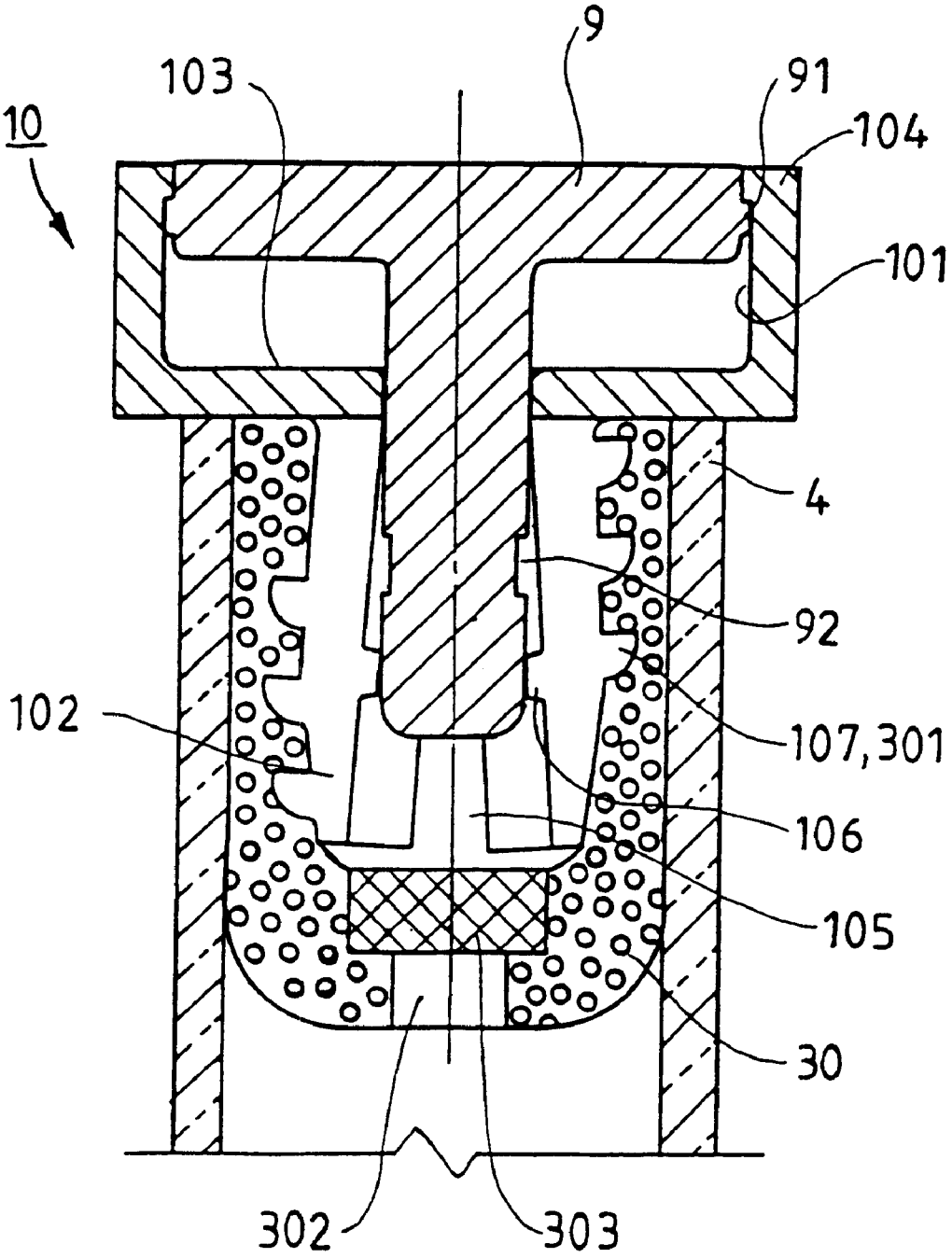
FIG. 16 is a partial sectional view of the bottle plug in accordance with the eighth embodiment of the present invention in the first step of closing bottle process.

FIG. 16 illustrates the bottle plug in accordance with the eighth embodiment of the present invention in the first step of closing bottle process. Referring to FIG. 16, the outer circumference of the elastomer member 30 corresponding to the expansion portion of the body 10 is adapted to sealably confront the inner circumference of the bottle neck 4 when the distal end of the plug 9 engaged with the inner circumference 106 of the body 10. While the leg of the plugs is rested on the inner circumference of the body 10, the annular flange 91 is positioned at the topside of the groove 101 in order to perform the function of positioning the plug 9 securely locked in the body 10.

Referring again to FIG. 16, the plug 90 can be manually pressed downward along the inner circumference of the wall 104 by users for removing bottle plug so that the groove 92 is engaged with out of the protrusion 106 to shrink the walls 102. The wall 802 is shrunk inwardly and thus the outer diameter of the bottle plug will reduce due to shrinkage of the body 10. While the groove 92 of the plug 9 is engaged with the protrusion 106 of the body 10, the annular flange 91 is positioned at the bottom side of the groove 101 in order to perform the function of removing the bottle plug. The position of the plug 9 at the topside or bottom side of the groove 101 performs the function of indicating whether the bottle neck 4 has previously opened or the bottle plug has been used. The plug 9 cannot remove from the body 10 due to the groove 92 engaged with the protrusion 106 for preventing reuse.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A bottle plug comprising:

a monolithic body defining a space having an inner circumference forming a retracted surface projecting inwardly with respect to an axis of the body to define an expansion portion;

a plug having a leg configured and dimensioned to engage the retracted surface of the body, said plug urging said expansion portion to radially expand as the plug is pushed into the body; and an elastomer member configured and dimensioned to receive the combination of the body and the plug;

wherein an outer circumference of the elastomer member corresponding to the expansion portion of the body is configured and dimensioned to seal the inner circumference of the bottle neck when the bottle plug is inserted into the bottle neck such that insertion of the plug into the expansion portion urges the outer circumference of the elastomer member to expand radially to thereby seal the inner circumference of the bottle neck.

2. A bottle plug comprising:

a body providing an annular partition having an upper surface and a lower surface, a wall axially extending from the upper for defining a compartment and a plurality of flexible walls axially extending from the lower surface for defining an expansion portion;

a plug providing a top and a leg, the top is received in the compartment and the leg is engaged with the expansion portion for expanding; and an elastomer member adapted to receive the combination of the body and the plug;

wherein an outer circumference of the elastomer member corresponding to the expansion portion of the body is adapted to sealably confront the inner circumference of the bottle neck by the leg engaging with the expansion portion when the bottle plug is inserted into the bottle neck.

3. The bottle plug as defined in claim 2, wherein the leg further provides a slightly tapered end engaged with the expansion portion.

4. The bottle plug as defined in claim 2, wherein a protrusion is formed on the inner circumference of each the flexible wall to provide the expansion portion.

5. The bottle plug as defined in claim 2, wherein a radially outer annular surface of the top provides an annular groove extended around an axis of the plug, and the groove adapted to engage with a rib of the body while the plug is inserted into the body.

6. The bottle plug as defined in claim 2, wherein a radially outer annular surface of the top of the plug provides a thread; and a thread and a recession co-axially formed on an inner circumference of the wall and abutting parallel each other;

the thread of the plug is adapted to tighten with the thread of the body while the plug is inserted into the body;

the top of the plug is restricted in lock position as it drops into the recession of the body.

7. The bottle plug as defined in claim 6, wherein the top of the plug provides a slot for manually or automatically screwing it.

8. The bottle plug as defined in claim 2, wherein a protrusion is formed on the inner circumference of the flexible walls to provide the expansion portion engaged with a recession of the leg of the plug while the plug is inserted into the body.

9. The bottle plug as defined in claim 2, wherein an annular groove provides on a bottom of an outer circumference of a wall; a tear strip connects between the bottom of the wall and the annular partition so that the wall can tear off from the body along its groove.

10. The bottle plug as defined in claim 2, wherein the body provides an annular flange at an edge of a hole of the partition for holding the inserted leg of the plug slightly tight.

11. The bottle plug as defined in claim 2, wherein a bottom of the elastomer member provides a hole and a filter arranged therein, the filter is made of cork material and permits only a miniscule amount of air to enter the bottle.

12. A bottle plug comprising:

a body providing an annular partition having an upper surface and a lower surface, a wall axially extending from the upper for defining a compartment and a plurality of flexible walls axially extending from the lower surface for defining an expansion portion, an inner circumference of each the flexible wall provides an engagement means;

a plug providing a top and a leg, the top is received in the compartment and the leg is engaged with the expansion portion for expanding and provides an engagement means for engaging with the engagement means of the body; and an elastomer member adapted to receive the combination of the body and the plug;

wherein an outer circumference of the elastomer member corresponding to the expansion portion of the body is adapted to sealably confront the inner circumference of the bottle neck by the leg engaging with the expansion portion when the bottle plug is inserted into the bottle neck.

13. The bottle plug as defined in claim 12, wherein the leg further provides a slightly tapered end engaged with the expansion portion.

14. The bottle plug as defined in claim 12, wherein a protrusion is formed on the inner circumference of each the flexible wall to provide the expansion portion.

15. The bottle plug as defined in claim 12, wherein the plug provides an annular wall extended from the radially outer annular surface in a direction from the top to the leg; an annular tear strip is attached to the rim of the wall and thus an inner lip forms a retainer for retaining the annular plate of the body while the plug is inserted into the body.

16. The bottle plug as defined in claim 12, wherein an annular groove provides on a bottom of an outer circumference of a wall; a tear strip connects between the bottom of the wall and the annular partition so that the wall can tear off from the body along its groove.

17. The bottle plug as defined in claim 12, wherein the body provides an annular flange at an edge of a hole of the partition for holding the inserted leg of the plug slightly tight.

18. A bottle plug comprising:

a body providing an annular partition having an upper surface and a lower surface, a wall axially extending from the upper for defining a compartment and a plurality of flexible walls axially extending from the lower surface for defining an expansion portion, an inner circumference of the wall provides a groove;

a plug providing a top and a leg, the top is received in the compartment and the leg is engaged with the expansion portion for expanding, a radially outer annular surface provides a rib for engaging with the groove of the body; and an elastomer member adapted to receive the combination of the body and the plug;

wherein an outer circumference of the elastomer member corresponding to the expansion portion of the body is adapted to sealably confront the inner circumference of the bottle neck by the leg engaging with the expansion portion when the bottle plug is inserted into the bottle neck.

19. The bottle plug as defined in claim 18, wherein the inner circumference of each the flexible wall provides an engagement means engaged with an engagement means provided on the leg of the plug.

20. The bottle plug as defined in claim 19, wherein the inner circumference of each the flexible wall provides a protrusion engaged with a groove provided on the leg of the plug.

21. The bottle plug as defined in claim 18, wherein an inner circumference of the wall provides a first groove and a second groove; the rib is engaged with the first groove in order to perform the function of positioning the plug that securely locked in the body, and the rib is engaged with the second groove in order to perform the function of positioning the plug that securely locked in the body.

22. The bottle plug as defined in claim 18, wherein an annular first flange of the top is positioned at the topside of a groove in order to perform the function of positioning the plug securely locked in the body and at the bottom side of the groove in order to perform the function of removing the bottle plug.

23. A bottle plug comprising:

a body providing an annular partition having an upper surface and a lower surface, a wall axially extending from the upper for defining a compartment and a plurality of flexible walls axially extending from the lower surface for defining an expansion portion, an inner distal circumference of each the wall provides a slightly retracted surface projecting inwardly;

a plug providing a top and a leg, the top is received in the compartment and the leg is engaged with the expansion portion for expanding and provides an annular flange for engaging with the retracted surface of the body; and an elastomer member adapted to receive the combination of the body and the plug;

wherein an outer circumference of the elastomer member corresponding to the expansion portion of the body is adapted to sealably confront the inner circumference of the bottle neck by the leg engaging with the expansion portion when the bottle plug is inserted into the bottle neck.

24. The bottle plug as defined in claim 23, wherein the inner circumference of each the flexible wall provides an engagement means engaged with an engagement means provided on the leg of the plug.

25. The bottle plug as defined in claim 24, wherein the inner circumference of each the flexible wall provides a protrusion engaged with a groove provided on the leg of the plug.

26. The bottle plug as defined in claim 23, wherein an inner circumference of the wall provides a first groove and a second groove; the rib is engaged with the first groove in order to perform the function of positioning the plug that securely locked in the body, and the rib is engaged with the second groove in order to perform the function of positioning the plug that securely locked in the body.

27. The bottle plug as defined in claim 23, wherein a radially outer annular surface of the top of the plug provides a thread; and a thread and a recession co-axially formed on an inner circumference of the wall and abutting parallel each other;

the thread of the plug is adapted to tighten with the thread of the body while the plug is inserted into the body;

the top of the plug is restricted in lock position as it drops into the recession of the body.

28. The bottle plug as defined in claim 23, wherein an annular first flange of the top is positioned at the topside of a groove in order to perform the function of positioning the plug securely locked in the body and at the bottom side of the groove in order to perform the function of removing the bottle plug.

29. The bottle plug as defined in claim 23, wherein the annular flange is engaged with a distal end of each the flexible wall as the plug is restricted in lock position.

30. The bottle plug as defined in claim 23, wherein a bottom of the elastomer member provides a hole and a filter arranged therein, the filter is made of cork material and permits only a miniscule amount of air to enter the bottle.

* * * * *